United States Patent [19]

Langle et al.

[11] 4,110,058

[45] Aug. 29, 1978

[54] VACUUM-OPERATED LIQUID PUMP

[76] Inventors: Juan Pedro Langle; Miguel Juan Langle, both of Campichuelo 1539-Avellaneda-Pcia, Buenos Aires, Argentina

[21] Appl. No.: 748,754

[22] Filed: Dec. 8, 1976

[30] Foreign Application Priority Data

Dec. 9, 1975 [AR] Argentina ..... 205772

[51] Int. Cl.[2] ..... F04B 43/06; F04B 45/00; F01L 31/18

[52] U.S. Cl. ..... 417/395; 417/402; 91/352; 92/13.2

[58] Field of Search ..... 417/402, 395, 387, 311; 123/139 AH; 92/13.2, 95, 133; 251/298, 149.2, 228; 91/352, 353

[56] References Cited

U.S. PATENT DOCUMENTS

| | | | |
|---|---|---|---|
| 1,780,336 | 11/1930 | Canton | 91/353 |
| 2,221,071 | 11/1940 | Barfod | 417/402 |
| 2,242,582 | 5/1941 | Jencick | 417/311 |
| 2,552,261 | 5/1951 | Coughlin | 417/395 |
| 2,641,107 | 6/1953 | Rappl | 123/139 AH |
| 2,713,830 | 7/1955 | Harry et al. | 123/139 AH |
| 2,713,854 | 7/1955 | Conover | 123/139 AH |
| 2,765,809 | 10/1956 | Lamar | 137/625.31 |
| 2,948,221 | 8/1960 | Carver | 92/13.2 |
| 3,377,922 | 4/1968 | Spender et al. | 92/133 |

FOREIGN PATENT DOCUMENTS

| | | | |
|---|---|---|---|
| 103,814 | 3/1926 | Austria | 123/139 AH |

*Primary Examiner*—Carlton R. Croyle
*Assistant Examiner*—Thomas I. Ross
*Attorney, Agent, or Firm*—Steinberg & Blake

[57] ABSTRACT

A vacuum-operated liquid pump includes a pumping member and a housing defining a pump chamber in which the pumping member moves along suction inlet and pressure discharge strokes. The pumping member divides the pumping chamber into a liquid space on one side of the pumping member and a gas space on the other side of the pumping member. A liquid-supply communicates with the liquid space for responding to movement of the pumping member along its suction inlet stroke to deliver liquid to the liquid space. A liquid discharge also communicates with the liquid space for responding to movement of the pumping member along its pressure discharge stroke to discharge liquid out of the liquid space. A passage communicates with the gas space for placing the latter in communication with a source of vacuum, while a valve cooperates with this passage for alternately placing the latter in communication with the source of vacuum and in communication with the outer atmosphere. This valve is operatively connected with the pumping member to be operated thereby for placing the passage in communication with the source of vacuum when the pumping member reaches the end of its pressure discharge stroke and for placing the passage in communication with the outer atmosphere when the pumping member reaches the end of its suction inlet stroke.

9 Claims, 7 Drawing Figures

VACUUM-OPERATED LIQUID PUMP

BACKGROUND OF THE INVENTION

The present invention relates to pumps.

In particular, the present invention relates to liquid pumps.

The present invention particularly relates to fuel pumps forming part of internal combustion engines. Pumps of this latter type are of course very well known. They have over the years been operated in a number of ways such as by gravity, by utilizing the Steward system which is already out of service, and by conventional mechanical drives practically universally adapted to all types of internal combusion engines. Also electrically operated liquid pumps of this latter type are known. However, such electrically operated pumps are not used to the extent of mechanically driven pumps because of the construction, operation, and maintenance costs involved in connection with electrically operated pumps.

The conventional mechanically driven liquid pumps of the above type generally include a link or lever arm which is supported for turning movement and which at one end is connected to a pumping element such as a diaphragm while the other end of this link or lever arm is actuated by a rotary cam mounted on the camshaft of the engine. Such a link or lever arm is subjected to considerable stress along its whole length and undergoes a considerable amount of wear, and at times breaks or is otherwise injured in a manner preventing the desired engine operation from going forward.

Similar although not identical problems are encountered in connection with electrically operated pumps of the above type. In addition to the above problems, the electrically operated pumps, although they may be free of mechanical stress, nevertheless require a high degree of tolerance in the manufacture of the components for energizing the system, and the calibration of electrical contacts as well as the maintenance thereof are problems encountered with this type of pump which generally requires a highly specialized technician in order to make repairs and adjustments and assure the best possible operation of such a pump. By reason of these factors such pumps are undesirably expensive.

SUMMARY OF THE INVENTION

It is accordingly a primary object of the present invention to provide a liquid pump which will avoid the above drawbacks.

In particular, it is an object of the present invention to provide a liquid pump capable of being operated by a source of vacuum so as to avoid the problems encountered with mechanically or electrically operated pumps as set forth above.

It is in particular an object of the invention to provide a vacuum-operated liquid pump which is suitable for use with an automobile engine, for example, with the vacuum encountered in the intake manifold of the engine itself being utilized as the source of vacuum for operating the pump of the invention.

It is furthermore an object of the present invention to provide a pump of the above type which can easily be adjusted so as to provide an optimum operation.

Moreover it is an object of the present invention to provide a pump of the above type which does not include mechanical elements such as lever arms or the like which are subjected to considerable stress and wear and which does not limit the location of the pump in accordance with the particular location of the camshaft, for example, this latter limitation of mechanically operated pumps being a considerable problem inasmuch as it prevents the liquid pump from being situated at a desired location in many designs.

It is moreover an object of the present invention to provide a vacuum-operated liquid pump which can readily be adapted for use on any internal combustion engine to serve as a fuel pump for the latter. This universal utility of the pump of the invention is in sharp contrast with even electrically operated fuel pumps which are not of universal applicability inasmuch as they require a predetermined voltage for the operation.

According to the invention, the vacuum-operated liquid pump includes a pumping member and a housing means defining a pump chamber in which the pumping member is movable along suction inlet and pressure discharge strokes. The pumping member divides the pump chamber into a liquid space on one side of the pumping member and a gas space on the other side of the pumping member. A liquid-supply means communicates with the liquid space for responding to movement of the pumping member along its suction inlet stroke to deliver liquid to the liquid space. A discharge means communicates with the liquid space to discharge liquid out of the latter in response to movement of the pumping member along its pressure discharge stroke. A spring means is operatively connected with the pumping member for urging the latter to move along its pressure discharge stroke. A passage means communicates with the gas space for placing the latter in communication with a source of vacuum, while a valve means cooperates with the passage means for alternately placing the latter in communication with the source of vacuum and in communication with the outer atmosphere. This valve means is operatively connected with the pumping member to be operated thereby for placing the passage means in communication with the source of vacuum when the pumping member reaches the end of its pressure discharge stroke and for placing the gas space in communication with the outer atmosphere when the pumping member reaches the end of its suction inlet stroke.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
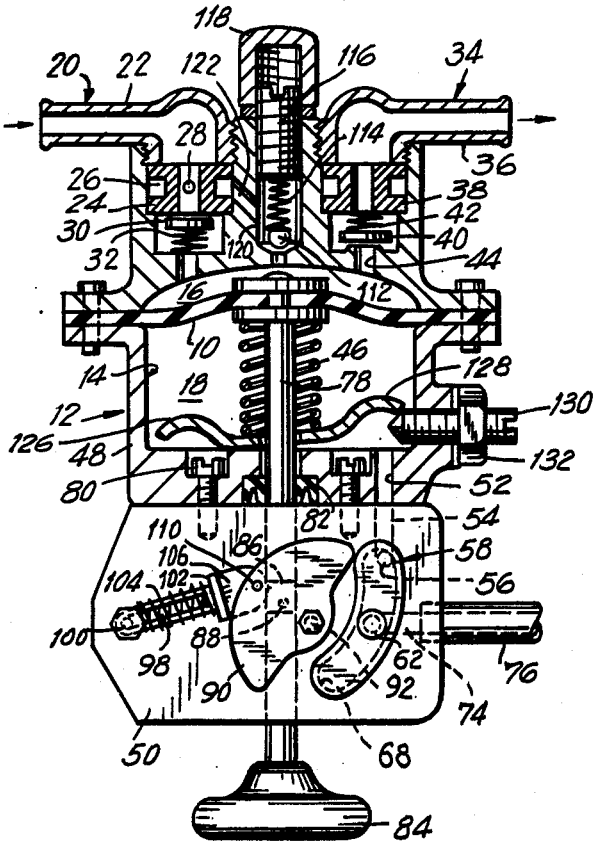
FIG. 1 is a schematic partly sectional elevation of one possible embodiment of a pump according to the invention.
Figure 2:
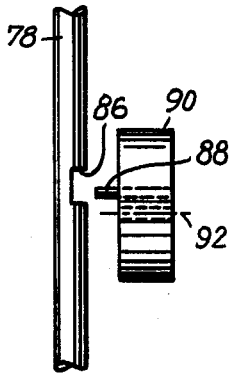
FIG. 2 is a schematic illustration of a rod and rocking member of FIG. 1 shown in FIG. 2 in the position which these parts take when the pump has the position of FIG. 1.

Referring now to FIGS. 1 and 2, there is illustrated therein a pumping member 10 which in the illustrated example is in the form of a diaphragm, although this pumping member 10 could as well take the form of a suitable piston. A pump housing means 12 defines in its interior a pump chamber 14 in which the pumping member 10 is accommodated for movement downwardly from the position of FIG. 1 to the position of FIG. 3 along a suction inlet stroke and upwardly from the position of FIG. 3 to the position of FIG. 1 along a pressure discharge stroke. This pumping member 10 divides the chamber 14 into a liquid space 16 situated above the member 10, as viewed in FIGS. 1 and 3, and a gas space 18 situated below the member 10, as viewed in FIGS. 1 and 3.

A liquid-supply means 20 communicates with the liquid space 16 for supplying liquid such as fuel thereto in response to movement of the pumping member 10 along its suction inlet stroke. This liquid-supply means 20 includes the tube 22 which communicates with any suitable source of liquid such as a fuel tank and which is threaded into a suitable fitting of the housing means 12 as illustrated. The tube 22 delivers the liquid to the hollow interior of a sleeve 24 situated in a suitable recess of the housing 12 and itself formed for a purpose referred to below with an exterior circular groove 26 communicating with the interior of the sleeve 24 through one or more bores 28. Just beneath the sleeve 24 the liquid supply means 20 includes a one-way valve made up of a plate 30 urged by a spring 32 upwardly toward the bottom end surface of the sleeve 24 so as to close the bore thereof.

A discharge means 34 is connected with the housing means 12 and communicates with the liquid space 16 for discharging liquid under pressure therefrom. This discharge means 34 includes a tube 36 fixed to a suitable fitting of the housing means 12 as illustrated in FIGS. 1 and 2 and adapted to communicate with a unit which receives the liquid, such as, for example, a carburetor when the structure of the invention is used as a fuel pump. The liquid discharge means 34 also includes a sleeve 38 and a one-way valve made up of a plate 40 and a spring 42 urging the plate 40 downwardly, as viewed in FIGS. 1 and 3, so as to close the opening 44 through which the liquid space 16 communicates with the discharge means 34.

Figure 3:
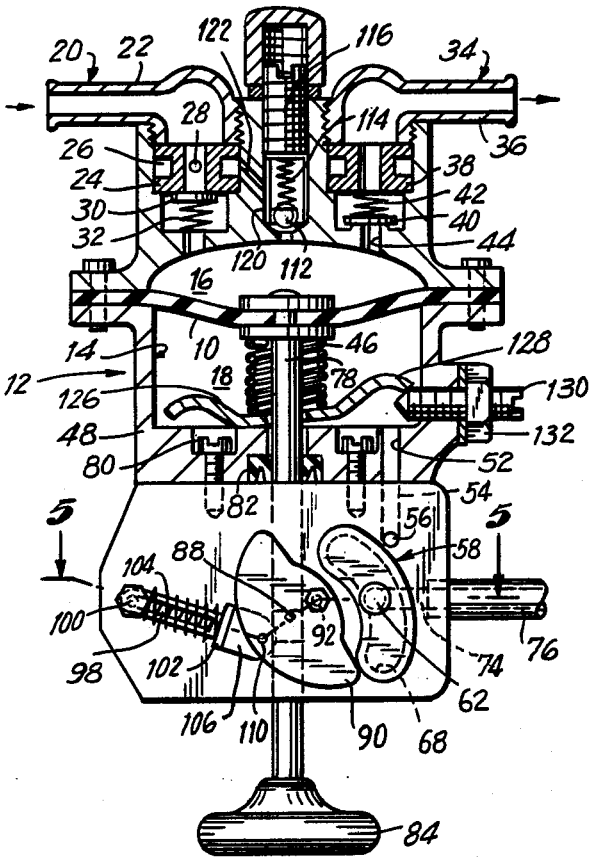
FIG. 3 is a schematic partly sectional elevation of the pump of FIG. 1 shown in FIG. 3 when the pumping member is at the end of its suction inlet stroke, while the pumping member is shown in FIG. 1 at the end of its pressure discharge stroke.

It is thus apparent that in response to downward movement of the pumping member 10, as viewed in FIGS. 1 and 3, the valve 30 will automatically open to admit liquid into the space 16, while the valve 40 remains closed, while during the opposed discharge pressure stroke of the pumping member 10, in an upward direction, as viewed in FIGS. 1 and 3, the valve 40 will open automatically while the valve 30 will be closed.

Situated in the gas space 18 is a spring means 46 which acts on the pumping member 10 to urge the latter along its pressure discharge stroke.

The housing means 12 includes the upper unit 48 which is shown in section in FIGS. 1 and 3 and a lower block 50 to which the unit 48 is fixed in a fluid-tight manner, these units 48 and 50 being formed with aligned bores 52 and 54 which form a continuous passage means communicating with the gas space 18. The lower end of the bore 54, as viewed in FIGS. 1 and 3, has a horizontal portion extending from its vertical portion and terminating in the open end 56 shown in FIG. 3. This passage means 52, 54, 56 is adapted to be placed in communication with a source of vacuum in a manner described below.

Figure 5:
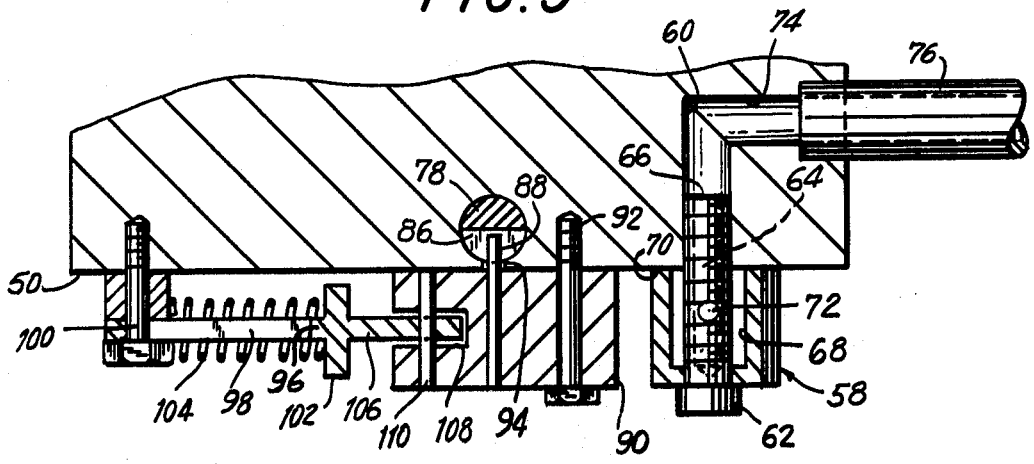
FIG. 5 is a sectional plan view taken along line 5—5 of FIG. 3 in the direction of the arrows.

A valve means 58 cooperates with the passage means 52, 54, 56 so as to alternately place the latter in communication with a source of vacuum and in communication with the outer atmosphere. This valve means 58 is in the form of an elongated member of curved configuration as illustrated. The block 50 has a threaded bore 60 (FIG. 5) into which a bolt 62 is threaded, this bolt passing through an opening formed in the valve means 58 so as to support the latter for turning movement on the block 50. The bolt 62 is itself formed with a bore 64 extending along the interior of the bolt 62 from its end 66, and this bolt 62 passes through an opening of the valve means 58 to support the latter for turning movement. The valve means 58 has a hollow interior 68 as well as an end surface 70 slidably and fluid-tightly engaging the exterior surface of the block 50. The bore 64 in bolt 62 terminates in the interior of the bolt adjacent to its head which is illustrated in FIG. 5, and the bolt is formed with one or more radial openings 72 communicating with the bore 64. The bore 60 has in the block 50 an extension 74 communicating with the interior of a tubular member 76 threaded into the block 50, this tubular member 76 communicating, for example, with the intake manifold of the engine. Thus, the member 76 as well as the bore portion 60 and 74 together with the hollow interior of the bolt 62 form a conduit means placing the hollow interior 68 of the valve means 58 in communication with a source of vacuum, and through this hollow interior 68 of the valve means 58 it is possible for the passage means 52, 54, 56 to communicate with the source of vacuum when the valve means 58 is in the position shown in FIG. 1.

The valve means 58 is operatively connected with the pumping member 10 to be operated thereby. For this purpose the pumping member 10 is fixed to an elongated rod 78 which extends through the spring 46 as well as through aligned bores of the units 48 and 50 of the housing means 12. The unit 48 is fixed to the block 50 by way of bolts 80 situated to the rear of the rod 78, as viewed in FIGS. 1 and 3. Moreover, a suitable sealing means 82 is provided at the region where the rod 78 extends from the bore of unit 48 into the bore of the unit 50. This rod 78 extends completely through the block 50 to the exterior thereof where the rod 78 is fixed with a suitable handle member 84 so that it is possible to reciprocate the rod 78 manually in order to move the pumping member 10 manually if desired.

Figure 6:
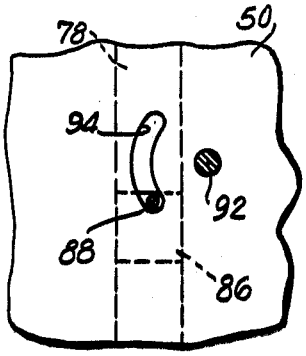
FIG. 6 is a fragmentary elevation of part of the exterior of the housing means of FIGS. 1 and 2 with the rocking member removed so as to show the structure behind the rocking member.

The rod 78 is formed at a part thereof situated in the block 50 with a recess 86 which receives a projecting portion or pin 88 fixed to and projecting from a rocking member 90 supported for rocking movement by a pin or bolt 92 threaded into the block 50 and passing through a bore of the rocking member 90. The block 50 is formed with a curved slot 94 (FIG. 6) communicating with the bore through which the rod 78 extends and extending along a circle whose center is in the axis of the pivot pin or bolt 92. The projecting portion 88 of the rocking member 90 extends through the slot 94 into the recess 86 of the rod 78 so that in response to movement of the rod 78 the rocking member 90 will be rocked between the positions thereof shown in FIGS. 1 and 3. The valve means 58 is situated in the path of rocking movement of the rocking member 90 so as to be turned thereby between the positions shown in FIGS. 1 and 3. This rocking member 90 has a certain weight so that it acts also by inertia to rock between the positions shown in FIGS. 1 and 3.

In addition, an overcenter means acts on the rocking member 90 to contribute to the rocking thereof. This overcenter means includes an elongated lever 96 formed with a longitudinal slot 98 through which a bolt 100 passes to support the lever 96 for turning as well as longitudinal movement, this bolt 100 being threaded into the block 50. The lever 96 has an enlarged end 102 engaged by one end of the spring 104 which is coiled around the lever 96 between its enlarged end 102 and the pin 100. The enlarged end 102 is fixed with a substantially rigid fin or blade 106 which projects from the enlarged end 102 into a recess 108 formed in the rocking member 90, the latter carrying a pin 110 which extends across this recess 108 and through a hole formed in the right end of the fin 106, as viewed in FIG. 5 as well as in FIGS. 1 and 3. Thus the spring 104 seeks to press the fin 106 toward the pin 110. The pivot 100 for the lever 96 is at the same elevation as the pivot 92 for the rocking member 90. Thus when the rod 78 moves downwardly from the position of FIG. 1 to the position of FIG. 3, the spring 104 will initially be compressed while a shoulder of the recess 86 of rod 78 engages the pin 88 to turn the rocking member 90 toward the position of FIG. 3, and as soon as the pin 110 moves below the line interconnecting the axes of the pins 100 and 92, the spring 104 expands to contribute to the turning of the rocking member 90 to the position of FIG. 3. In the same way the overcenter spring means operates during return of the rocking member 90 from the position of FIG. 3 to the position of FIG. 1 to contribute to the turning thereof as soon as the pin 110 moves above the line interconnecting the axes of the pivots 100 and 92. Of course, the lever 96 not only turns about the pivot 100 but in response to the force of the spring 104 it is capable of moving longitudinally along the pin 100 toward the right, as viewed in FIGS. 1 and 3, while the spring 104 can yield to permit the lever 96 to move toward the left along the pin 100.

A pressure-limiting means is provided for limiting the pressure of the liquid in the space 16 to a predetermined maximum. This pressure-limiting means includes a one-way valve which includes the ball member 112 urged downwardly by a spring 114 which engages an end of an adjusting screw 116 which can be turned in a threaded bore of the housing means 12 so as to adjust the limiting pressure. A hollow cap 118 is threaded onto the projecting end of the screw 116 to act as a lock nut as well as to protect the screw 116. These elements 112, 114, 116 are situated in a bore 120 formed in the upper part of the unit 48 of the housing 12, and this bore 120 communicates through an inclined branching bore 122 of the housing 12 with the groove 26 of the sleeve 24 of the supply means 20. Thus, if during the discharge pressure stroke of the pumping member 10 the pressure of the liquid exceeds a predetermined maximum, the valve 112 will automatically open in opposition to the force of the spring 114 so that excess liquid will flow through the branch bore 122 into the groove 26 and through the opening 28 to reach the tube 22 in order to be returned in this way to the supply means 20. It is thus possible by way of the screw 116 to adjust the pressure of the liquid discharged through the discharge means 34.

Figure 7:
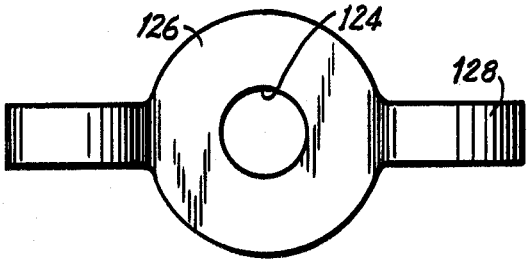
FIG. 7 is an illustration of an adjusting member for adjusting the force of a spring.

It is also possible, according to a further feature of the invention, to adjust the force of the spring means 46 so as to control the operation in this way also. For this purpose the rod 78 extends freely through an aperture 124 formed in the center of a springy metal plate member 126 which is of the configuration shown in FIG. 7 as well as in FIGS. 1 and 3. A tongue 128 of the member 126 presses against the inner end of an adjusting screw 130 extending through a threaded bore of the housing 12 and held in its adjusted position by a lock nut 132. Thus by turning the screw 130 it is possible to act on the tongue 128 so as to deflect the member 126 in order to change the pressure of the spring 46 and in this way also adjust the operation of the pump.

Figure 4:
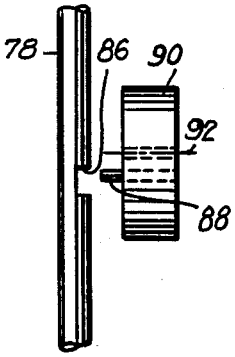
FIG. 4 is a schematic illustration of the rod and rocking member of FIG. 2 shown in FIG. 4 in the position which these parts take at the end of the suction inlet stroke of the pumping member shown in FIG. 3.

The operation of the above structure is believed to be clear from the above description and drawings. Thus, normally the structure will remain at rest in the position shown in FIG. 1 where the spring means 46 is expanded and the pumping member 10 is at the end of its discharge stroke. With the parts in this position when the engine is started, the vacuum from the intake manifold will communicate with the gas space 18 to reduce the pressure thereof so as to suck the pumping member 10 downwardly along its suction stroke, thus admitting liquid through the supply means 20 into the liquid space 16. This operation continues until, as a result of the downward movement of the rod 78, the rocking member 90 is snapped over to the position shown in FIG. 3, whereupon the valve means 58 turns to the position of FIG. 3, uncovering the open end 56 of the passage means 52, 54, 56, so that the latter now communicates with the outer atmosphere. As a result the gas space 18 communicates with the outer atmosphere enabling the spring 46 to expand, thus displacing the pumping member 10 along its pressure discharge stroke, thus causing the liquid to discharge through the discharge means 34 until during the upward movement of the rod 78 the rocking member 90 snaps over to the position shown in FIG. 1, whereupon the above cycle of operations is repeated. The manner in which the rod 78 moves upwardly and downwardly with the rocking member 90 moving at its pin 88 above and below the turning axis of the rocking member 90 is shown in FIGS. 2 and 4. Thus, with the above structure of the invention it is possible to utilize the vacuum of the engine itself in order to operate the fuel pump in the above-described manner in response to and controlled by the vacuum prevailing in the intake manifold connected to the tube 76 as described above.

Certain variations are possible with the above-described structure. For example, instead of providing a separate rocking member 90 and valve means 58, these two elements can be combined into a single member which rocks and which has a hollow interior capable of providing communication between the suction conduit means 76 and the opening 56 in the manner described above for the valve means 58 itself.

The rocking member 90 acts by inertia to provide a smooth operation for the pump, this member 90 in effect being a counterweight. Moreover, whenever desired, as for testing purposes, the rod 78 is accessible for manual operation as set forth above.

What is claimed is:

1. In a vacuum-operated liquid pump, a pumping member and pump housing means defining in its interior a pump chamber in which said pumping member is movable along suction inlet and pressure discharge strokes, said pumping member dividing said chamber into a liquid space on one side of said pumping member and a gas space on the other side of said pumping member, supply means commuicating with said liquid space for supplying liquid thereto in response to movement of said pumping member along said suction inlet stroke thereof, discharge means communicating with said liquid space for discharging liquid under pressure out of the latter during movement of said pumping member along said pressure discharge stroke thereof, passage means formed at least in part in said housing means and communicating with said gas space for placing the latter in communication with a source of vacuum, spring means operatively connected with said pumping member for urging the latter along said pressure discharge stroke thereof, and valve means cooperating with said passage means for placing the latter alternately in communication with the outer atmosphere and through means in said valve means in communication with the source of vacuum, said valve means being operatively connected with said pumping member to be operated thereby for placing said passage means in communication with the source of vacuum when said pumping member reaches the end of said pressure discharge stroke thereof and in communication with the outer atmosphere when said pumping member reaches the end of said suction inlet stroke thereof, the operative connection of said valve means to said pumping member including a rod fixed to said pumping member to reciprocate therewith, and a rocking member turnably carried by said housing means, said rod being formed with a recess and said rocking member having a projection fixed thereto and extending into said recess for transmitting movement between said rod and rocking member, the latter being rocked in opposed directions during the suction inlet and pressure discharge strokes of said pumping member, and said valve means responding to rocking of said rocking member in one direction to place said passage means in communication with the source of vacuum and in the opposite direction to place the passage means in communication with the outer atmosphere, said passage means terminating in an open end which when uncovered by said valve means communicates with the outer atmosphere and which when covered by said valve means communicates through said valve means with said source of vacuum, said valve means itself being carried by said housing means for rocking movement between positions covering and uncovering said open end of said passage means, and said valve means being situated in the path of rocking movement of said rocking member to be engaged and turned thereby to said position covering said open end of said passage means when said pumping member reaches the end of its pressure-discharge stroke and to a position uncovering said open end of said passage means when said pumping member reaches the end of its suction inlet stroke, said valve means having no mechanical connection to said rocking member and being moved only by being situated in the path of movement of said rocking member, with said valve means remaining stationary in one or the other of said positions thereof until said valve means is engaged and moved by said rocking member.

2. The combination of claim 1 and wherein a pressure-limiting means communicates with said liquid space for determining a maximum pressure of the liquid therein.

3. The combination of claim 2 and wherein an adjusting means is operatively connected with said pressure-limiting means for adjusting the maximum pressure determined thereby.

4. The combination of claim 2 and wherein said pressure-limiting means is in the form of a one-way valve which opens automatically when the maximum pressure set by said pressure-limiting means is reached, said one-way valve providing communication between said liquid space and said supply means for returning liquid to said supply means when said one-way valve opens upon occurrence of the maximum limiting pressure in said liquid space.

5. The combination of claim 1 and wherein an over-center spring means is operatively connected with said rocking member for contributing to the rocking thereof in the opposed directions of rocking.

6. The combination of claim 1 and wherein said open end of said passage means is situated at an outer surface of said housing means, said means of said valve means for communicating with the source of vacuum including a hollow interior forming a continuation of said passage means when placing the latter in communication with the source of vacuum, and conduit means communicating with the hollow interior of said passage means and adapted to be placed in communication with a source of vacuum for placing the latter in communication with said passage means through the hollow interior of said valve means when the latter covers said open end of said passage means.

7. The combination of claim 1 and wherein said spring means is situated in said gas space for acting on said pumping member to urge the latter along said pressure discharge stroke thereof.

8. The combination of claim 7 and wherein an adjusting means is operatively connected with said spring means for adjusting the force thereof.

9. The combination of claim 1 and wherein said rod extends to the exterior of said housing means to be accessible for manual reciprocation to enable said pumping member to be manually reciprocated.

* * * * *